United States Patent [19]

Shigemori et al.

[11] 3,958,583

[45] May 25, 1976

[54] MONEY DISPENSER

[75] Inventors: Hideto Shigemori; Motoaki Fukunaga, both of Himeji, Japan

[73] Assignee: Glory Kogyo Kabushiki Kaisha, Himeji, Japan

[22] Filed: Dec. 18, 1973

[21] Appl. No.: 425,825

[30] Foreign Application Priority Data

Dec. 23, 1972 Japan ..... 48-2261

[52] U.S. Cl. ..... 133/4 R; 194/DIG. 26

[51] Int. Cl.[2] ..... G07D 1/00

[58] Field of Search ..... 194/4 R, DIG. 9 B; 133/1 R, 2, 4 R, 5 R; 221/2, 7, 9; 271/259

[56] References Cited

UNITED STATES PATENTS

| | | | |
|---|---|---|---|
| 3,426,879 | 2/1969 | Walker | 194/DIG. 9 B |
| 3,675,816 | 7/1972 | Bourke et al. | 194/DIG. 9 B |
| 3,683,943 | 8/1972 | De Crepy | 133/1 R |
| 3,756,256 | 9/1973 | Hatanaka et al. | 133/4 R |
| 3,784,790 | 1/1974 | Hatanaka et al. | 194/DIG. 9 B |
| 3,791,392 | 2/1974 | Hanson | 133/1 R |

*Primary Examiner*—Robert B. Reeves
*Assistant Examiner*—Joseph J. Rolla
*Attorney, Agent, or Firm*—Wenderoth, Lind & Ponack

[57] ABSTRACT

A money dispenser is provided with first and second detectors for detecting a bank note passing therethrough, the first detector being disposed at the money loading side of a money conveyer and the second detector being disposed at the money unloading side of the same so that a money dispensing operation is checked twice as to whether an amount of money actually dispensed is coincident with an amount of money registered to be dispensed. Furthermore, according to another aspect of this invention, the money dispenser is provided with display units which indicate the amount dispensed until the next money dispensing operation starts.

4 Claims, 4 Drawing Figures

MONEY DISPENSER

BACKGROUND OF THE INVENTION

This invention relates to money dispensers and more particularly to a money dispensation confirming system employed in the money dispenser.

In a conventional money dispenser for dispensing money with a plurality of monetary denominations, money is delivered to a money dispensing outlet through a money conveying system such as shown in FIG. 1. For convenience in description, it is assumed that the money dispenser dispenses bank notes with two monetary denominations, that is, 10,000 yen and 1,000 yen. The money conveying system comprises money containers 1M and 1S which contain 10,000-yen bank notes and 1,000-yen bank-notes respectively. The money containers 1M and 1S are moved vertically by container moving means as is shown by the arrow 2 in such a manner that they are set in alignment with a money dispensing mechanism 3 upon application of signals representing the denominations of 10,000 yen and 1,000 yen, respectively. For instance, when the signal representing the denomination of 1,000 yen is applied to the container moving means, the money container 1S is moved upward and is set so that bank notes are picked up by the money dispensing mechanism 3. The money dispensing mechanism 3 picks up bank notes one by one from the money container and inserts them between rollers 5 provided at the money loading side of money conveying means, or a money conveyor 4, which delivers them to the money dispensing outlet through rollers 6 provided at the money unloading side of the conveyor 4 to drop them into a tray 7.

In order to count the number of sheets of bank notes dispensed, the money dispenser thus organized further comprises a first detector 8, such as a photoelectric detector, which is provided at the money loading side of the conveyer 4, or at a position immediately after the rollers 5. The first detector 8 senses a bank note passing therethrough to produce a detection signal A and supplies it to circuit means shown as part of FIG. 2.

The detection signals A thus produced are applied through a distribution circuit 11 to a first counter, or a dispensed money counter 12, separately according to the monetary denominations. The first counter 12 counts the detection signals A and accordingly the number of sheets of bank notes unloaded on the conveyer 4.

The money thus counted as the number of sheets by the counter 12 separately according to the denominations is converted into an amount of money, which is applied to a comparator, or a coincidence detecting circuit 13, while an amount of money to be dispensed which has been registered in a registration memory register 15 by a ten-key 14 is applied to the coincidence detecting circuit 13, whereby both amounts of money are compared with each other by the circuit 13. When they coincide with each other, the coincidence detecting circuit 13 produces coincidence signals Bm and Bs separately according to the denominations. Upon production of the coincidence signal Bm or Bs, the money dispensing operation of the money dispenser is ended. In this connection, in general, all of the control means of the money dispenser are deenergized immediately after the production of the coincidence signal in order that the money dispenser be prevented from carrying out an of erroneous operation due to some cause.

When it is necessary to confirm if the amount of money registered by an operator coincides with the amount of money dispensed out of the money dispenser, contents of the memory register 15 and the counter 12 are displayed on a display unit 16 for an amount of money registered and an unit 17 for an amount of money dispensed so that the operator can confirm the coincidence by comparing these contents thus displayed with each other.

However, this method of confirming the coincidence of two amounts of money is not always reliable. For instance, sometimes bank notes on the conveyer 4 are caught by something while being conveyed by the conveyer 4. That is, if money conveying conditions of the conveyer 4 are abnormal, the amount of money dropped into the tray 7 is smaller than that registered even if the indications on the display units 16 and 17 coincide with each other. Accordingly, it is necessary that the money dispenser be so designed that the number of sheets of bank notes dropped in the tray 7 is correctly counted so as to enable the operator to readily find out the shortage of money. This is important especially for the prevention of troubles caused in the dispensation of money from a money dispenser.

There is another kind of trouble in the dispensation of money from the money dispenser; that is, an operator can tell a lie as to the amount of money dispensed if he wants to. More specifically, in the case when, although bank notes have been conveyed into the tray 7 without trouble, the operator claims that the amount of money paid to him is different from, or less than, the amount of money he registered, it is impossible to judge whether his claim is correct or not if the money dispenser is not provided with means suitable for the judgement. This means may be the display units 16 and 17. However, the amounts of money displayed on these display units disappear when the coincidence signals Bm and Bs have been produced and the money dispensing operation has stopped, and the money dispenser becomes ready for the next money dispensing operation. That is, after the disappearance of the amounts of money, the display units 16 and 17 are useless for the judgment described above.

Furthermore, if the money dispenser has troubles in its control system due to some reasons as a result of which the coincidence detecting operation described above cannot be carried out, sometimes the amount of money in the tray may be greater than the amount of money registered. In order to eliminate such a trouble, it is necessary to provide a device in the money dispenser which can detect the incorrect dispensation of money.

SUMMARY OF THE INVENTION

Accordingly, a primary object of this invention is to provide a money dispensation confirming system in a money dispenser which can eliminate all of the above described difficulties accompanying conventional money dispensers.

Another object of the invention is to provide a money dispensation confirming system in a money dispenser which has a simple construction and can be readily added to conventional money dispenser.

The foregoing objects and other objects of this invention can be achieved by the provision of a money dispensation confirming system in a money dispenser comprising a first detector provided at the money loading side of a money conveyer, for detecting a piece of money passing therethrough to produce a first detection output, first detection outputs from the first detector being counted as a number of pieces of money dispensed, which system further comprises a second detector provided at the money unloading side of the conveyer, for detecting a piece of money passing therethrough to produce a second detection output, a denomination confirming gate circuit for gating a second detection output from said second detector according to the denominations of money loaded on the conveyer whenever said first detector produces a detection output and a dispensation confirming counter for counting the second detection output obtained through said denomination confirming gate circuit.

The nature, utility and principle of this invention will become more apparent from the following detailed description and the appended claims when read in conjunction with the accompanying drawings, in which like parts are designated by like reference numerals and characters.

DETAILED DESCRIPTION OF THE INVENTION

With reference to the accompanying drawings, one example of a money dispensation confirming system in a money dispenser according to this invention will be described. In this connection, it is assumed that the denominations of money to be dispensed out of the money dispenser are 10,000-yen and 1,000-yen, for convenience in description.

Figure 1:
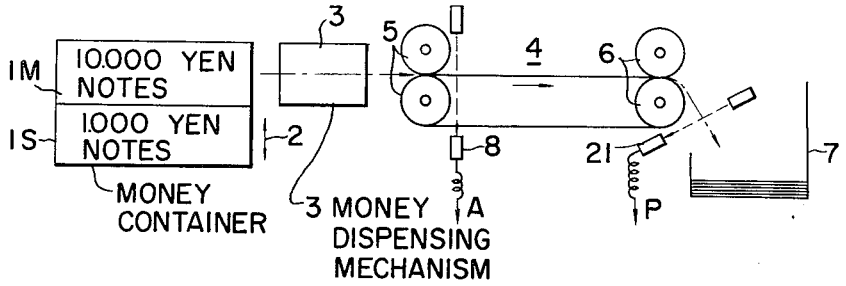
FIG. 1 is a schematic explanatory diagram illustrating a money conveying route in a money dispenser according to this invention.

In this money dispensation confirming system, in addition to the first detector 8 which has been described above, a second detector 21 similar in operation to the first detector 8 is provided at the money unloading side of the conveyor 4, that is, between the conveyer 4 and the tray 7 which have also been described above, as is shown in FIG. 1.

Figure 2:
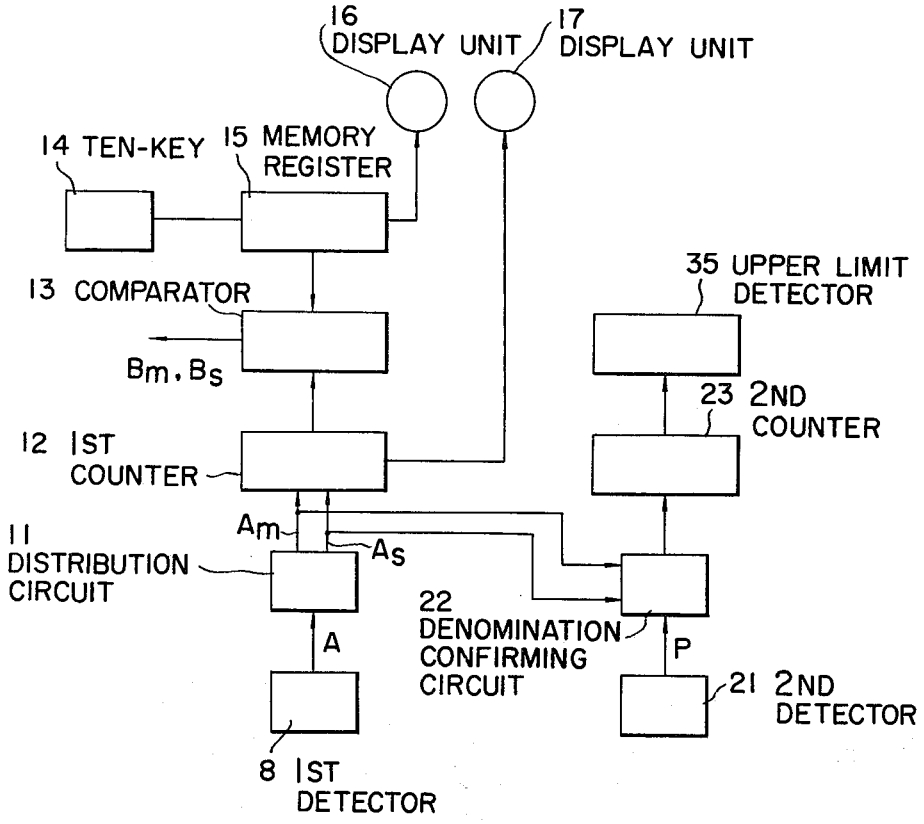
FIG. 2 is a block diagram illustrating one example of a money dispensation confirming system according to this invention.

Whenever the second detector 21 detects a bank note passing therethrough, it produces a detection pulse P in the same manner as the first detector 8. The pulses P from the detector 21 are applied through a denomination confirming gate circuit 22 to a second counter, or a dispensation confirming counter 23, as is clear from FIG. 2. The gate circuit 22 is controlled by detection pulses Am and As which are produced by the above-described distribution circuit 11 separately according to the monetary denominations of 10,000-yen and 1,000-yen.

Figure 3:
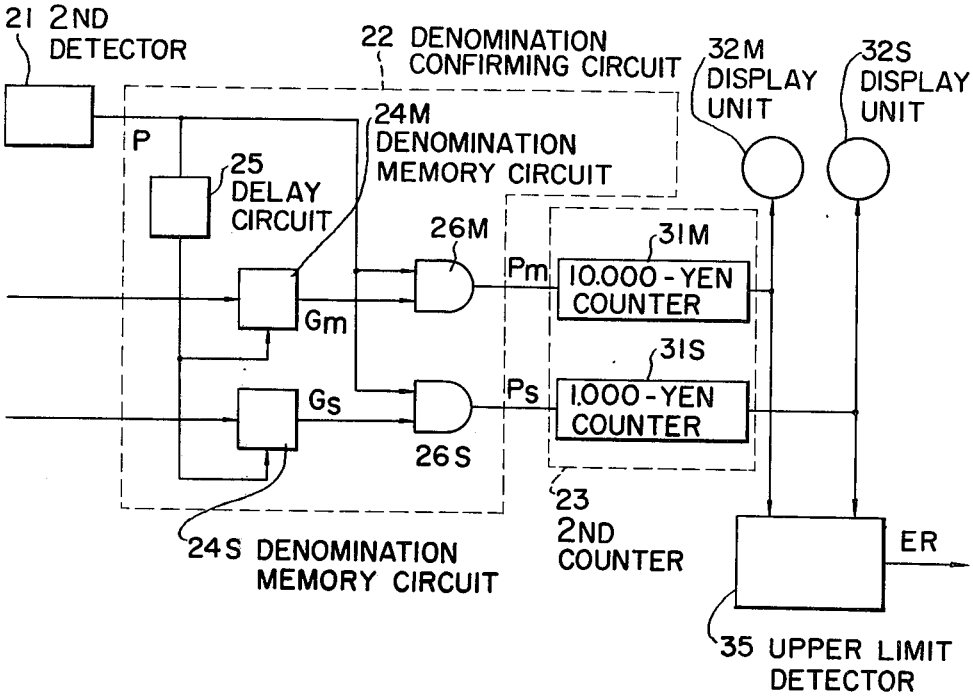
FIG. 3 is also a block diagram illustrating in detail a part of the block diagram shown in FIG. 2.
Figure 4:
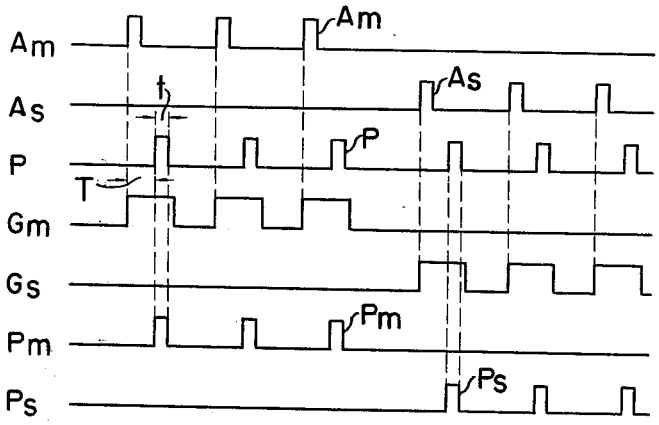
FIG. 4 is a waveform chart illustrating various signals produced in the money dispensation confirming system shown in FIG. 2.

The denomination confirming circuit 22, as is shown in FIG. 3, comprises denomination memory circuits 24M and 24S provided for the monetary denominations, that is, 10,000-yen and 1,000-yen, respectively. The detection pulses Am and As as is shown in FIG. 4 are applied from the distribution circuit 11 to the circuits 24M and 24S, respectively. The circuits 24M and 24S are set whenever the detection pulses Am and As are applied thereto, respectively.

On the other hand, the detection pulse P, as is shown in FIG. 3, is applied through a delay circuit 25 to the reset terminals of the denomination memory circuits 24M and 24S. In this operation, the delay circuit 25 operates to delay the application of the pulse P by a predetermined period of time t. Thus, when it has passed the period of time t after the application of the detection signals Am and As to the circuits 24M and 24S, respectively, the circuits 24M and 24S are reset and produce outputs Gm and Gs as is shown in FIG. 4, respectively. The outputs Gm and Gs thus produced are applied to output gate circuits 26M and 26S to open the latter. When the gate circuits 26M and 26S are thus opened, they produce detection pulses Pm and Ps, respectively.

The dispensation confirming counter 23 comprises a 10,000-yen counter 31M and a 1,000-yen counter 31S which respectively count the detection pulses Pm and Ps produced by the gate circuits 26M and 26S.

In the money dispensation confirming system thus organized, if first 10,000-yen notes are supplied to the conveyer 4 from the 10,000-yen note container 1M and then 1,000-yen notes are supplied to the container is from the conveyer 4, first the circuit 24M is set by the pulse Am (FIG. 4) produced by the distribution circuit 11 whenever a 10,000-yen note is passed through the first detector 8. If it is assumed that a bank note supplied to the conveyer 4 takes a period of time T to reach the second detector 21 from the first detector 8 (the period of time T being hereinafter referred to as a conveying period of time T), the circuit 24M is reset when it has passed the delay time t after the arrival of the 10,000-yen note to the second detector 21. As is apparent from the above description, during the period the circuit 24M produces the output Gm (FIG. 4), the pulse Am is applied through the gate circuit 26M to the 10,000-yen counter 31M.

Thus, the circuit 24M stores the denomination of money supplied to the conveyer 4, that is, 10,000-yen whenever a 10,000-yen note passes through the first detector 8. Thereafter, the denomination stored in the circuit M24 is cleared by the detection pulse Pm when the dispensation of the 10,000-yen bank note into the tray is confirmed, that is, it is detected by the second detector 21.

When the last 10,000-yen note is supplied to the conveyer 4, the first detector 8 produces the last detection signal Am. This last detection signal Am causes the coincidence detecting circuit 13 to produce a coincidence output Bm by which the control system for the dispensation of 10,000-yen notes is stopped. Thereafter, the last 10,000-yen note is counted by the counter 31M.

Next, a necessary number of sheets of 1,000-yen notes are supplied to the conveyer 4 from the money container 1S and are counted in the same manner as in the dispensation of 10,000-yen notes described above.

Thus, as is clear from the above description, according to this invention, the addition of a simple system such as described above to the conventional money dispenser renders it possible to count the number of sheets of bank notes delivered into the money dispensing outlet correctly and separately according to the monetary denominations. Therefore, in the money dispenser, the function of detecting troubles with respect to bank notes which are caused while they are conveyed on the conveyer can be remarkably improved without impairing the money dispensing operation. This improvement can be further enhanced by so designing the dispensation confirming system that the results of the counting operations of the counters 31M and 31S are displayed on respective display units 32M and 32S and are maintained until the next money dispensing operation starts. In the system thus organized, even if the registered amount of money on display unit 16 and the dispensed amount of money on display unit 17 are both reset immediately after the completion of one money dispensing operation, an operator can confirm if the money dispenser has operated correctly since he can compare the amount of money dispensed for him with the indications displayed on the display units 32M and 32S. Thus, the occurrence of troubles due to the erroneous operation of the money dispenser can be minimized according to this invention.

In other words, the money dispensation confirming system is so designed that the counter 23 is not reset by the coincidence signals Bm and Bs from the coincidence detecting circuit 13, but when the next money dispensing operation is carried out, that is, a money dispensing command signal is produced by a dispensation start button, the counter 23 is reset by the money dispensing command signal whereby the indications on the display units 32M and 32S are cleared.

The money dispenser having the money dispensation confirming system thus organized, carries out its automatic money dispensing operation in the same manner as the conventional one and displays the amount of money dispensed on the display units 32M and 32S continuously even after the completion of the money dispensing operation. Accordingly, a man paid with money dispensed and a man responsible for the money dispenser can check if the amount of money dispensed is correct by referring to the indications on the display units 32M and 32S even after the completion of the money dispensing operation. In other words, a period of time during which these men can check if the amount of money dispensed is correct or not is provided between two succeeding money dispensing operations.

Therefore, the previously described troubles accompanying the conventional money dispenser, that is, the trouble caused while notes are conveyed by the conveyer and the trouble with respect to the amount of money dispensed which is caused after the completion of the money dispensing operation can be solved. Accordingly, the reliability of the money dispenser can be remarkably improved.

In the above description, the counter 23 is cleared when the money dispensing operation starts; however, the counter 23 may be so designed that it is cleared by a clear button.

Furthermore, in the case when the money dispenser has dispensed an amount of money more than that registered, such a trouble can be readily checked by the use of the count outputs from the counters 31M and 31S as follows: That is, the count outputs from the counters 31M and 31S are applied to an upper limit detector 35 in which a number of sheets of notes permitted to be dispensed is set in advance and, when the count contents of the counters 31M and 31S exceed the predetermined number of sheets of bank notes set in the upper limit detector 35, the detector 35 produces an error signal ER representing the fact that the money dispenser has dispensed an amount of money more than that registered. The error signal ER can be employed for immediately stopping the operation of the money dispenser and for sounding an alarm. Thus, the provision of the upper limit detector 35 can prevent the money dispenser from the dispensation of an excessive amount of money and improve the reliability of the money dispenser.

We claim:

1. A money dispenser comprising a money container section for storing pieces of money to be dispensed, a money conveying section for conveying pieces of money stored in the money container section one by one to a money dispensing outlet, a money counting section for counting the value of money dispensed by detecting each piece of money conveyed by the money conveying section, a memory section for storing data on the value of money designated to be dispensed, and a comparison section for comparing the content stored in the money counting section and the content stored in the memory section to control a money dispensing operation of said money dispenser, and an upper limit detector coupled to said money counting section for producing an error detection signal when the value of the money counted by said money counting section exceeds an upper limit value set in advance, whereby an over-dispensation of money caused when the control operation for suspending money dispensing operation is effected abnormally is indicated by the error detection signal.

2. A money dispenser as claimed in claim 1, wherein said money counting section comprises:

a. a first money detecting and counting means provided at the money loading side of said money conveying section for detecting each piece of money loaded onto said money conveying section and for counting the value of the money thus detected, so that when the data on the value of money thus counter coincides with said data stored in said memory section, the money loading operation is suspended, and b. a second money detecting and counting means provided at the money unloading side of said money conveying section for detecting each piece of money unloaded from said money conveying section to said money dispensing outlet for counting the value of the money thus detected, said upper limit detector being coupled to said second money detecting and counting means for being actuated thereby.

3. A money dispenser comprising a money container section for storing pieces of money to be dispensed, a money conveying section conveying pieces of money stored in the money container section one by one to a money dispensing outlet, a money counting section for counting the value of money dispensed by detecting each piece of money conveyed by by money conveying section, a memory section for storing data on the value of money designated to be dispensed, a comparison section for comparing the content stored in the money counting section and the content stored in the memory section to control a money dispensing operation of said money dispenser, and means coupled to said money counting section for holding the data on the value of money counted by said money counting operation for one money dispensing operation until the next money dispensing operation starts.

4. A money dispenser as claimed in claim 3, wherein, said money counting section comprises (*a*) a first detecting and counting means provided at the money loading side of said money conveying section for detecting each piece of money loaded onto said money conveying section and for counting the value of the money thus detected, so that when the data on the value of money thus counted coincides with said data stored in said memory section, the money loading operation is suspended, and (*b*) a second money detecting and counting means provided at the money unloading side of said money conveying section for detecting each piece of money unloaded from said money conveying section to said money dispensing outlet and for counting the value of the money thus detected, said second money detecting and counting means coupled to said means being for holding the data on the value of money counted until the next money dispensing operation starts.

* * * * *